US009254659B1

(12) United States Patent
Tamura et al.

(10) Patent No.: US 9,254,659 B1
(45) Date of Patent: Feb. 9, 2016

(54) LIQUID EJECTION APPARATUS AND LIQUID EJECTION HEAD

(71) Applicant: CANON KABUSHIKI KAISHA, Tokyo (JP)

(72) Inventors: Yasuyuki Tamura, Yokohama (JP); Yohei Nakamura, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/838,016

(22) Filed: Aug. 27, 2015

(30) Foreign Application Priority Data

Aug. 29, 2014 (JP) ..... 2014-175521

(51) Int. Cl.
*B41J 2/15* (2006.01)
*B41J 2/145* (2006.01)

(52) U.S. Cl.
CPC ..... *B41J 2/145* (2013.01)

(58) Field of Classification Search
CPC ..... B41J 2/145; B41J 2/16; B41J 2/155
See application file for complete search history.

(56) References Cited

U.S. PATENT DOCUMENTS

2003/0122902 A1* 7/2003 Sakaida ..... B41J 2/14209 347/68
2014/0111573 A1* 4/2014 Kyoso ..... B41J 2/145 347/19

FOREIGN PATENT DOCUMENTS

JP 06-155734 A 6/1994
JP 2007-090520 A 4/2007

* cited by examiner

*Primary Examiner* — Juanita D Jackson
(74) *Attorney, Agent, or Firm* — Canon USA Inc. IP Division

(57) ABSTRACT

A liquid ejection apparatus including: a liquid ejection head including two-dimensionally arranged pressure chambers, and corresponding ejection ports. On a surface on which the ejection ports are arranged, when a relative movement direction of a recording material is x, the direction perpendicular to the relative movement is y, a pitch of pixels is d, and m and n are different odd numbers of 3 or greater, the ejection ports are arranged in a manner such that and and nd are repeated alternately as the distance between the ejection ports adjoining in the y direction, and such that the ejection port arrays extending substantially linearly in an oblique direction to the x and y directions on an xy plane are formed. The ejection port arrays are constituted by (m+n)/2 ejection ports, and the ejection ports adjoining in the ejection port arrays are displaced by 2d in the y direction.

12 Claims, 8 Drawing Sheets

LIQUID EJECTION APPARATUS AND LIQUID EJECTION HEAD

BACKGROUND OF THE INVENTION

1. Field of the Invention

The present invention relates to a liquid ejection apparatus and a liquid ejection head.

2. Description of the Related Art

A recording system that uses a liquid ejection apparatus having a liquid ejection head configured to eject a liquid, such as ink, has various applications not only recording images on a recording material, such as paper. Hereinafter, "recording" refers to forming a desired dot group by ejecting a liquid including applications other than recording images on a recording material. The smallest component of the dot group to be formed is referred to as a pixel. The entire mechanism for ejecting a liquid provided in a liquid ejection head and consisting of ejection ports for ejecting droplets, pressure chambers communicating with the ejection ports, flow channels for supplying the liquid to the pressure chambers, and the like is referred to as an ejection mechanism unit.

There have recently been demands for high definition recording. To meet these demands, liquid ejection heads having a large number of ejection mechanism units arranged with high density have been developed. Arranging the ejection mechanism units with high density can be achieved by reducing the size of each ejection mechanism unit. Since there is a limit to the degree of reduction in size of each ejection mechanism unit, however, a large number of ejection mechanism units may be arranged in a predetermined range when the ejection mechanism units are arranged two-dimensionally.

An ordinary liquid ejection apparatus performs recording by ejecting a liquid while a recording material and a liquid ejection head are moving relatively. In a configuration in which the ejection mechanism units are arranged two-dimensionally, the size of the liquid ejection head is desirably reduced in the direction of the relative movement of the recording material.

Thus, the size of the entire liquid ejection head is reduced. Moreover, the liquid ejection head is generally manufactured at lower cost. Especially the size of a liquid ejection apparatus in which multiple liquid ejection heads are arranged, such as a color printer, is reduced. When recording is performed continuously by a plurality of liquid ejection heads, since a time difference between landing of the first droplet and landing of a subsequent droplet on a recording material, impairment in recording image quality caused by, for example, variation in bleeding of the liquid is reduced. Moreover, a decrease in relative position accuracy of dots related to conveying precision of the recording material is reduced.

To reduce the size of the liquid ejection head in the direction of the relative movement of the recording material, the ejection mechanism units need to be arranged with high density. If the size of the pixels to be recorded is constant, the range in which the ejection mechanism units are arranged in the direction of the relative movement substantially corresponds to the number of pixels per unit length/the number of ejection mechanism units per unit area. Thus, increasing the number of the ejection mechanism units per unit area is required. Moreover, the ejection ports of each ejection mechanism unit must be arranged at a pitch of the predetermined pixel in the direction perpendicular to the direction of the relative movement of the recording material.

Japanese Patent Laid-Open No. 6-155734 discloses a method for arranging ejection ports at the pitch equal to that of the pixel in the direction perpendicular to the direction of relative movement while disposing nozzles with high density, by combining four kinds of nozzles (which correspond to the ejection mechanism units).

Japanese Patent Laid-Open No. 2007-90520 discloses a method for arranging ejectors (which correspond to the ejection mechanism units) of the same configuration rotated by 180 degrees and two-dimensionally.

In the method disclosed in Japanese Patent Laid-Open No. 6-155734, the size of the liquid ejection head is reduced by combining nozzles of different types to increase the degree of freedom of arrangement and aspect ratio of the pressure chambers. Nozzles of different shapes, however, have different ejection characteristics. In the method disclosed in Japanese Patent Laid-Open No. 6-155734, there is a problem of unevenness caused in a recorded image due to the difference in the ejection characteristics of different types of nozzles.

In the method disclosed in Japanese Patent Laid-Open No. 2007-90520, as illustrated in FIGS. 10 and 11 thereof, the ejection ports are arranged at the pitch equal to that of the pixel in the direction perpendicular to the direction of the relative movement of the recording material. Details of arrangement of the ejectors, however, are not described in Japanese Patent Laid-Open No. 2007-90520. In the method disclosed in Japanese Patent Laid-Open No. 2007-90520, the ejectors are arranged at complicated distances in a manner such that the ejection ports are disposed at the pitch equal to that of the pixel. Thus, in the method disclosed in Japanese Patent Laid-Open No. 2007-90520, the entire ejection mechanism units are not necessarily arranged with high density.

FIG. 11 of Japanese Patent Laid-Open No. 2007-90520 illustrates a part of a configuration of the liquid ejection head illustrated in FIG. 10 of Japanese Patent Laid-Open No. 2007-90520. In FIG. 11 of Japanese Patent Laid-Open No. 2007-90520, the ejection ports are arranged on inclined lines between parallel main lines 6A and 6B disposed in each of the upper and lower areas of the drawing. The number of the ejection ports (i.e., ejectors) arranged on the inclined lines is recurrently four and three, and is not constant. Thus, because the ejection ports are disposed at the pitch of the pixel in the direction perpendicular to the direction of the relative movement, only three ejectors are disposed in some locations where four ejectors can be disposed actually in the up-down direction. In the method disclosed in Japanese Patent Laid-Open No. 2007-90520, the ejection mechanism units cannot be arranged with density as high as possible.

In FIG. 11 of Japanese Patent Laid-Open No. 2007-90520, the distance between ejection ports adjoining in the direction perpendicular to the direction of the relative movement of the recording material corresponds to two pixels where the adjoining ejection ports are close to each other, and 24 pixels where they are apart from each other. In Japanese Patent Laid-Open No. 2007-90520, recording is performed at a 2-pixel pitch by the ejectors of each of the upper and the lower areas of FIG. 11 and, as a whole, recording at a 1-pixel pitch is performed.

Setting the distance between adjoining ejection ports to correspond to two pixels is possible in a case where pixel density is very low, but is problematic in a case where the pitch of the pixels is small. For example, in a case where recording is performed at 1200 dots per inch (dpi), the pitch of the pixels is about 21 μm. In an ordinary design, the magnitude of an ejection port is about 20 μm. Thus, there is a problem that the thickness of the partition walls of the pressure chambers of adjoining ejectors becomes as thin as about 20 μm, of which insufficient rigidity may cause crosstalking. Moreover, if an appropriate distance is not provided between the ejection port and the partition wall, an ejecting direction of the droplet may be changed due to the existence of the partition wall.

As described above, in the methods disclosed in Japanese Patent Laid-Open Nos. 6-155734 and 2007-90520, it is difficult to arrange the ejection mechanism units with high density, while satisfying indispensable design requirements. The design requirements herein are: arranging the ejection ports at a pitch substantially equal to that of the pixel in the direction perpendicular to the direction of the relative movement of the recording material; and not impairing performance of each ejection mechanism unit even if the pitch of the pixel is small.

The present invention provides a liquid ejection apparatus and a liquid ejection head capable of arranging ejection mechanism units with high density, while satisfying indispensable design requirements.

SUMMARY OF THE INVENTION

A liquid ejection apparatus including: a liquid ejection head including, a plurality of two-dimensionally arranged pressure chambers, and a plurality of ejection ports each corresponding to the plurality of pressure chambers, wherein the liquid ejecting apparatus is configured to record on a recording material with a liquid ejected from the ejection ports while the liquid ejection head and the recording material are moving relatively, wherein, on a surface on which the ejection ports are arranged, if a direction of relative movement of the recording material is defined as an x direction, a direction perpendicular to the relative movement is defined as a y direction, a pitch of pixels to be recorded in the y direction is denoted by d, and m and n are different odd numbers of 3 or greater, the plurality of ejection ports are arranged in a manner such that md and nd are repeated alternately as the distance between the ejection ports adjoining in the y direction, and such that a plurality of ejection port arrays extending substantially linearly in an oblique direction with respect to the x direction and the y direction on an xy plane are formed, the ejection port arrays are constituted by (m+n)/2 ejection ports, and positions of the ejection ports adjoining in the ejection port array are displaced by 2d.

A liquid ejection head including: a liquid ejection apparatus having a liquid ejection head including a plurality of two-dimensionally arranged pressure chambers, and a plurality of ejection ports each corresponding to the plurality of pressure chambers, wherein, if a first direction on a surface on which the ejection ports are arranged is defined as an x direction, a direction perpendicular to the first direction is defined as a y direction, a pitch of pixels to be recorded in the y direction is denoted by d, and m and n are different odd numbers of 3 or greater, the plurality of ejection ports are arranged in a manner such that md and nd are repeated alternately as the distance between the ejection ports adjoining in the y direction, and such that a plurality of ejection port arrays extending substantially linearly in an oblique direction with respect to the x direction and the y direction on an xy plane are formed, the ejection port arrays are constituted by (m+n)/2 ejection ports, and positions of the ejection ports adjoining in the ejection port arrays are displaced by 2d.

According to the present invention, since the ejection ports constituting the adjoining ejection port arrays are disposed alternately in the y direction, the ejection ports may be arranged at the pitch of d, i.e., the same pitch in the y direction as that of the pixel to be recorded in the y direction. Since each ejection port array is constituted by (m+n)/2 ejection ports, the entire range in the y direction to be recorded by the pixels may fall within each ejection port array, and the ejection mechanism units including the ejection ports and the pressure chambers may be arranged with high density without creating useless space. Since m and n is odd numbers of 3 or greater, the thickness of the partition walls of the pressure chambers corresponding to the ejection ports adjoining in the y direction is sufficiently large, whereby performance of the ejection mechanism units is not impaired. Therefore, the ejection mechanism units may be arranged with high density, while satisfying design requirements.

Further features of the present invention will become apparent from the following description of exemplary embodiments with reference to the attached drawings.

DESCRIPTION OF THE EMBODIMENTS

Hereinafter, embodiments for implementing the present invention are described with reference to the drawings. Hereinafter, a direction of relative movement of a recording material on a surface of a liquid ejection head on which a plurality of ejection ports are arranged two-dimensionally (i.e., a first direction) is defined as an x direction, and a direction perpendicular to the direction of the relative movement (i.e., a second direction) is defined as a y direction. A direction perpendicular to the x direction and the y direction is defined as a z direction.

First Embodiment

Figure 1:
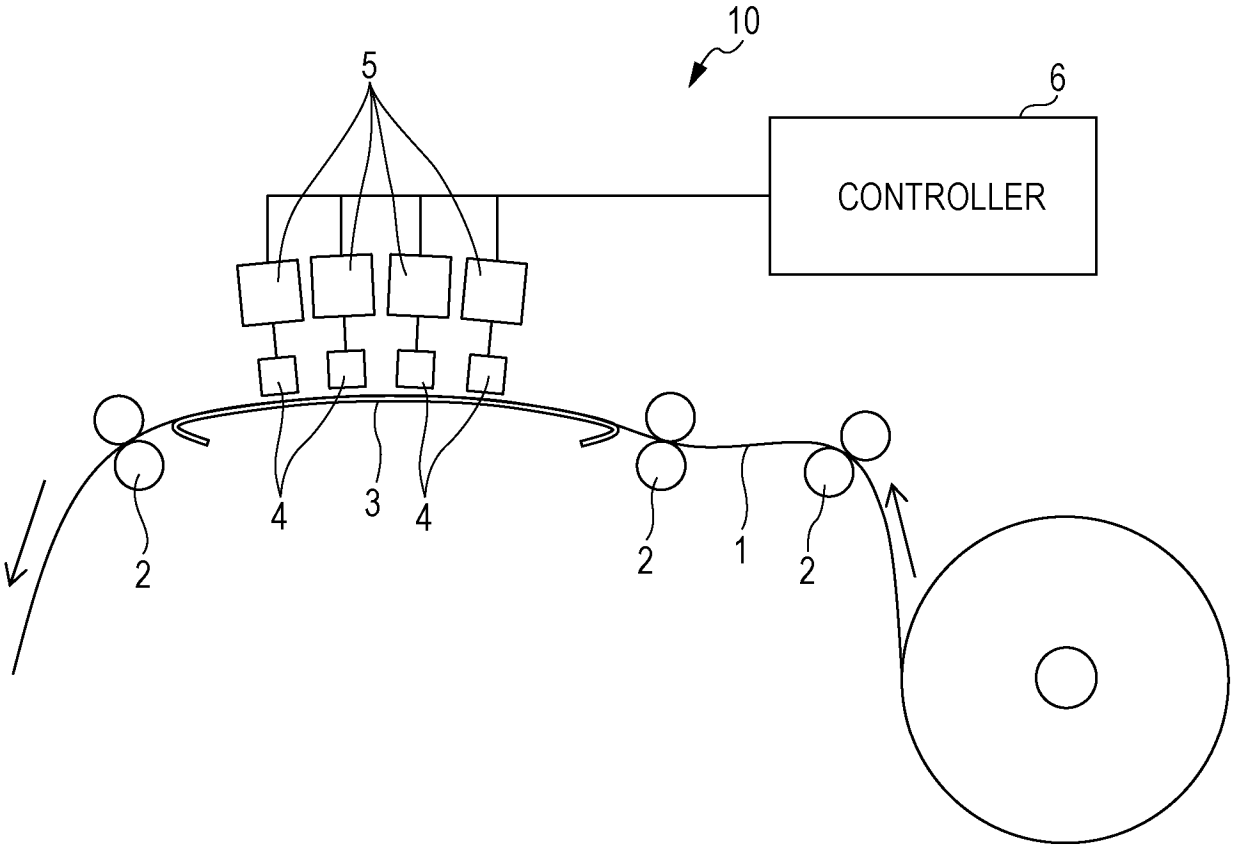
FIG. 1 illustrates a configuration of a liquid ejecting apparatus of an embodiment of the present invention.

FIG. 1 illustrates a configuration of a liquid ejecting apparatus 10 according to an embodiment of the present invention.

Recording paper 1 which is a recording material is conveyed in the arrow direction by a conveyance roller 2 which is a moving unit that conveys the recording material. Four liquid ejection heads 4 are provided to face the recording paper 1 which is conveyed on a platen 3. The liquid ejection heads 4 respectively eject cyan, magenta, yellow, and black liquids (i.e., ink) to record on the recording paper 1. A driving unit 5 which electrically drives a pressure generation unit which generates pressure for ejecting the liquid is connected to each of the liquid ejection heads 4. The driving unit 5 outputs a driving signal of the pressure generation unit in accordance with, for example, an image signal sent from a controller 6.

Figure 2A:
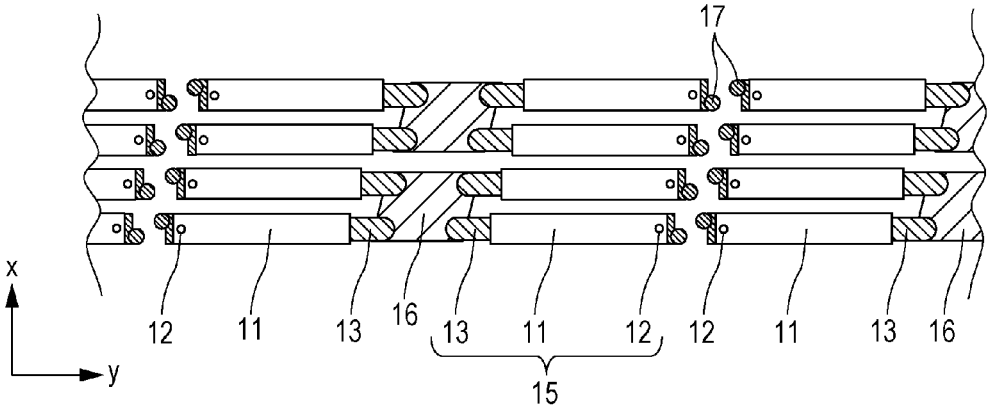
FIGS. 2A to 2C illustrate a main configuration of a head chip provided in the liquid ejection head illustrated in FIG. 1.
Figure 2B:
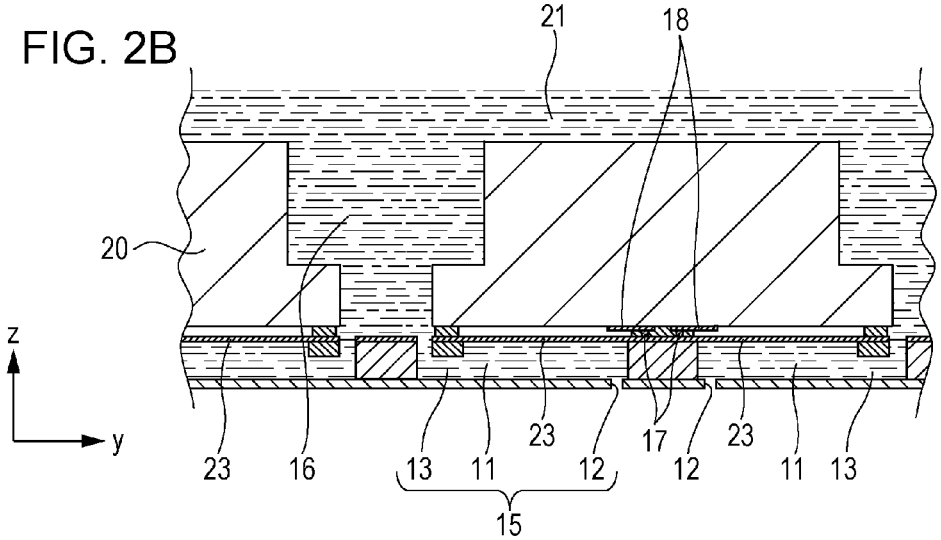

Each of the liquid ejection head 4 includes a head chip (not illustrated) in which a large number of ejection mechanism units (not illustrated) are arranged. FIG. 2A illustrates a main configuration of the head chip. FIG. 2A is a front perspective view and FIG. 2B is a cross-sectional view.

FIG. 2A illustrates a configuration in which four ejection mechanism units 15 each constituted by a pressure chamber 11, an ejection port 12, a flow channel 13, and the like are arranged in the x direction. The pressure chamber 11 is connected to an ejection port 12 near one end thereof in the y direction, and is connected to a supply portion 16 (i.e., a first supply portion) via the flow channel 13 near the other end thereof in the y direction. The ejection mechanism units 15 adjoining in the y direction are rotated by 180 degrees, i.e., are opposite in direction from the supply portion 16 toward the ejection port 12. The ejection mechanism units 15 are arranged linearly in an oblique direction on an xy plane. The ejection mechanism units 15 are arranged in the y direction in a manner such that the distance between the ejection ports 12 of the adjoining ejection mechanism units 15 becomes alternately large and small.

The supply portion 16 is provided in a region where the distance between the ejection ports 12 of the adjoining ejection mechanism units 15 in the y direction is large. The supply portion 16 is connected to four pressure chambers 11 via the flow channel 13 corresponding to each of the pressure chambers 11. Specifically, the supply portion 16 is connected, by the flow channel 13 corresponding to each of the pressure chambers 11, to the pressure chambers 11 of two ejection mechanism units 15 adjoining in the x direction and the pressure chambers 11 of two ejection mechanism units 15 facing the two ejection mechanism units 15 in the y direction via the supply portion 16.

In a case where only a single pressure chamber 11 is connected to a single supply portion 16, it is necessary to provide many supply portions 16. If the size of the supply portion 16 is reduced to provide many supply portions 16, flow resistance becomes large and driving at high frequencies becomes difficult and, therefore, the supply portion 16 needs to have a certain size. Thus, if only a single pressure chamber 11 is connected to a single supply portion, the number of the ejection mechanism units that can be arranged per unit area is not able to be increased.

In a case where the ejection mechanism units 15 adjoining in the y direction are the same in direction, the supply portion 16 needs to be provided at each of the arrays of the ejection mechanism units 15 arranged in the x direction, whereby the number of ejection mechanism units that can be disposed per unit area is not able to be increased. In the present embodiment, in contrast, the ejection mechanism units 15 adjoining in the y direction are opposite in direction, and the pressure chambers 11 of the ejection mechanism units 15 adjoining in the y direction via the supply portion 16 are connected to a single supply portion 16, whereby the ejection mechanism units 15 are arranged with high density. Although the pressure chambers of two ejection mechanism units 15 adjoining in the x direction are connected to a single supply portion 16 in FIG. 2A, pressure chambers 11 of three or more ejection mechanism units 15 adjoining in the x direction may be connected to a single supply portion 16.

As illustrated in FIG. 2B, the supply portion 16 is a hole formed in a substrate 20. The supply portion 16 is a two-stage hole, of which width becomes large at a portion connecting to a common liquid chamber 21. This configuration reduces flow resistance.

The flow path 13 is bent vertically to the substrate 20 and is connected to the supply portion 16. A vented piezoelectric element 23 as the pressure generation unit which generates pressure for ejecting the liquid in the pressure chamber from the ejection port 12 is provided in each pressure chamber 11. The piezoelectric element 23 provided in each pressure chamber 11 includes a common electrode and an individual electrode via an unillustrated piezoelectric member. The individual electrode of each piezoelectric element 23 is connected to discrete wiring 18 provided in the substrate 20 by a bump 17. The discrete wiring 18 is pulled out toward an end portion of the head chip 7 in the x direction, and is connected to the driving unit 5 by, for example, a flexible cable connected to the end portion. The common electrode is also connected to the driving unit 5 via the substrate 20 and the like by bump connection. This configuration may independently drive the piezoelectric element 23 provided in each pressure chamber 11 by a driving signal generated by the driving unit 5. A driving circuit constituted by, for example, a flip-flop may be provided near the end portion of the substrate 20 in the x direction.

Figure 2C:
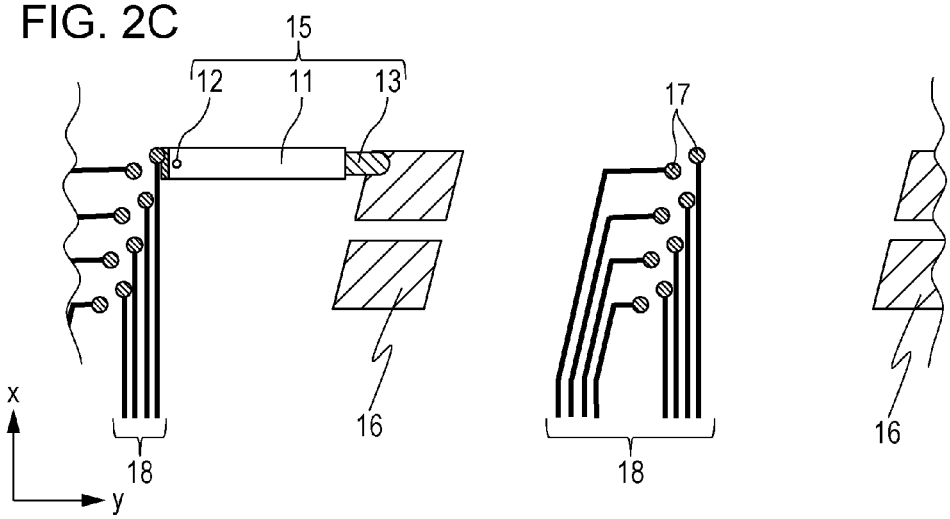

FIG. 2C illustrates an arrangement of the discrete wiring 18. FIG. 2C illustrates only one ejection mechanism unit 15.

The ejection mechanism units 15 are arranged linearly in an oblique direction on the xy plane as described above. In this configuration, bending the discrete wiring 18 in a complicated manner to evade other bumps 17 of the ejection mechanism units 15 and the supply portions 16 when pulling out the discrete wiring 18 toward the bump 17 corresponding to each ejection mechanism unit 15 or in the x direction is unnecessary and, therefore, the wire length can be shortened. Thus, wiring resistance of the discrete wiring 18 may be lowered and favorable discharge performance may be obtained. Although only the discrete wiring 18 corresponding to the four ejection mechanism unit 15 arranged in the x direction is illustrated in FIG. 2C, the discrete wiring may be provided easily even if a greater number of ejection mechanism units 15 are arranged in the x direction.

The method for pulling out the discrete wiring 18 to the outside of a two-dimensionally arranged ejection mechanism unit group and connecting to, for example, a driving circuit generally includes pulling out the wiring in the x direction and pulling out the wiring in the y direction. In the method for pulling out the wiring in the y direction, the wire length becomes long and the wiring density becomes high near the end portion of the substrate in the y direction in a liquid ejection head with a large recordable width. There is therefore a problem that the size of the head chip in the x direction needs to be increased. The present embodiment, in contrast, has a configuration suitable for the pulling out of the wiring in the x direction and, therefore, is suitable for a liquid ejection head with a large recordable width.

Figure 3:
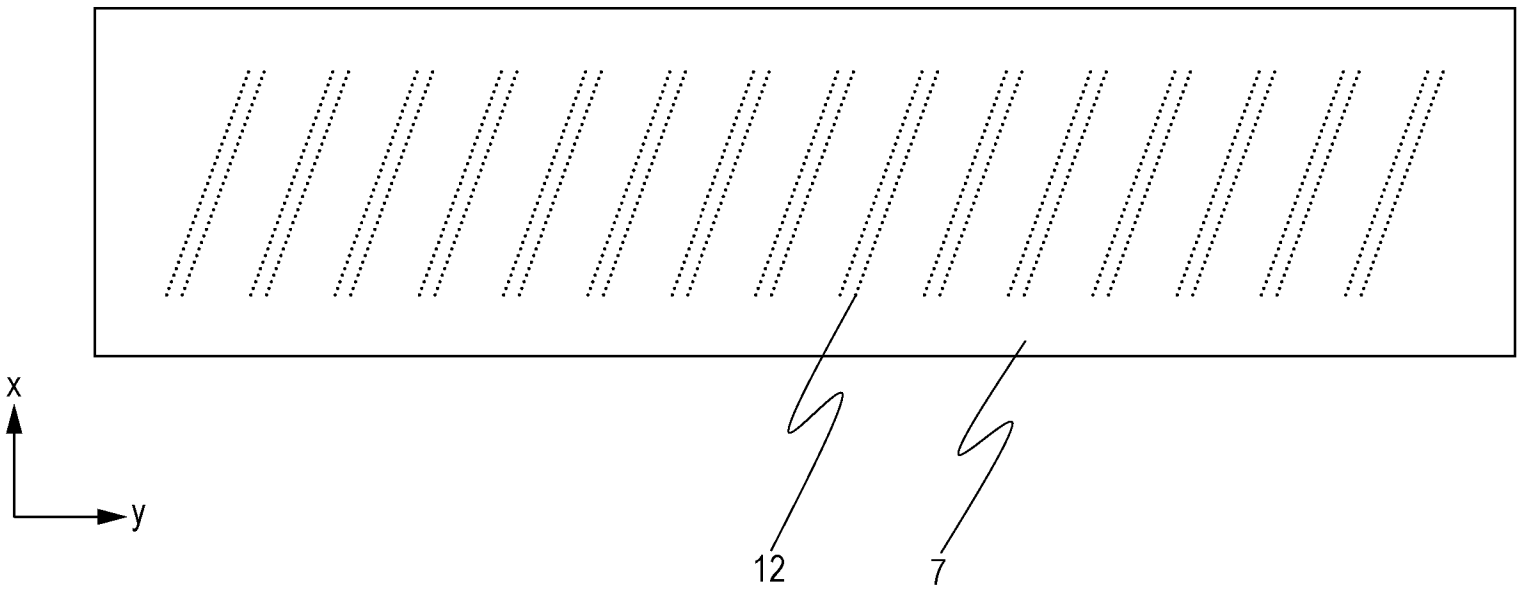
FIG. 3 illustrates an exemplary arrangement of ejection ports in the liquid ejection head illustrated in FIGS. 2A to 2C.

FIG. 3 illustrates an exemplary arrangement of the ejection ports 12 in the head chip 7.

As illustrated in FIG. 3, 35 arrays of the ejection mechanism units 15 are provided in the x direction, and 1024 ejection ports 12 are provided in the entire head chip 7.

The ejection ports 12 are arranged substantially linearly in an oblique direction on the xy plane, and the number of ejection ports 12 constituting each line is 35. The distances between the ejection ports 12 adjoining in the y direction are recurrently and and nd. Here, d is a constant and is 21.2 μm equal to the pitch of the pixels in the y direction to be recorded. In FIG. 3, m is 59 and n is 11.

Figure 4:
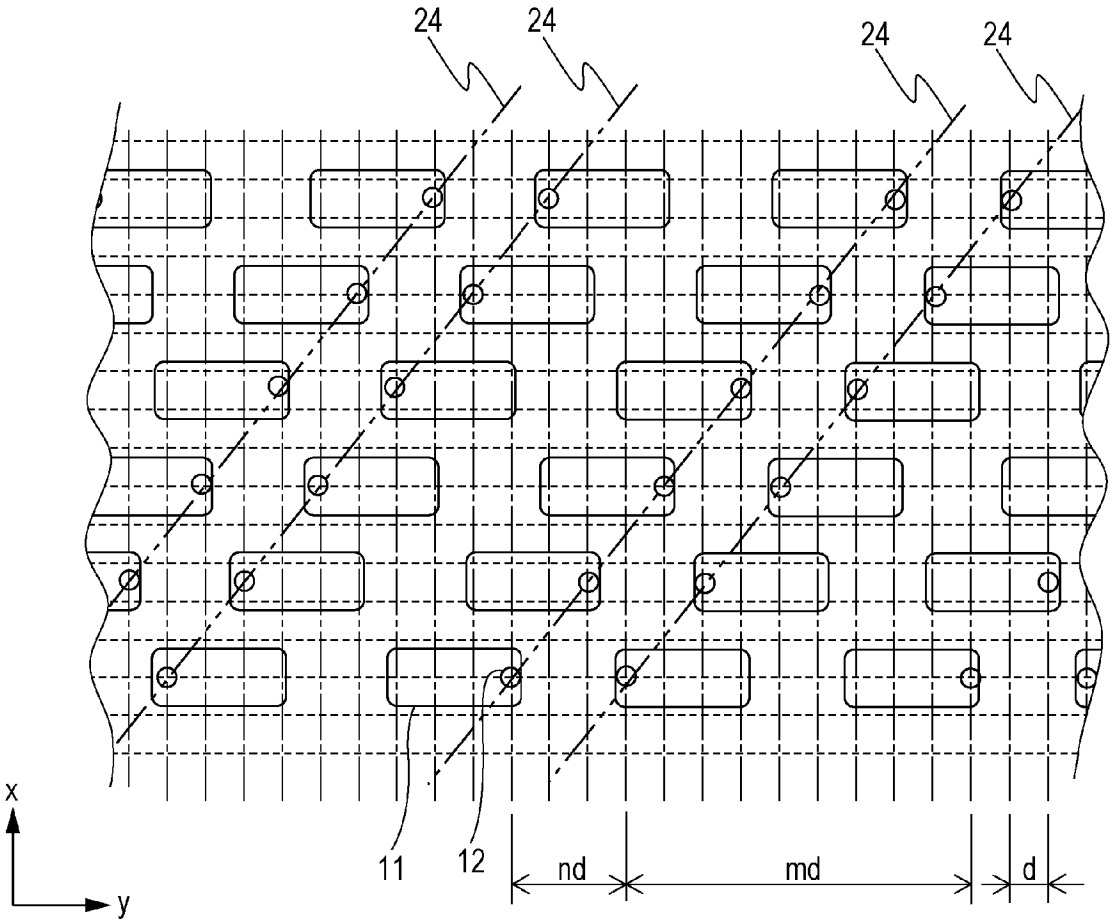
FIG. 4 illustrates an exemplary arrangement of the ejection ports in the liquid ejection head illustrated in FIGS. 2A to 2C.

Next, regularity of arrangement of the ejection ports 12 according to the present embodiment is described with reference to FIG. 4. For the ease of illustration, FIG. 4 illustrates a case where the number of ejection mechanism units 15 is relatively small (i.e., the number of ejection mechanism units 15 arranged in the x direction is 6). In FIG. 4, the grid illustrated by the vertical lines (dash-dot lines) and the horizontal lines (dotted lines) represents the magnitude of the pixels to be recorded. The pitch of the grid is d. In FIG. 4, the pressure chambers 11 and the ejection ports 12 are illustrated, but other configurations are not illustrated.

The distances between the ejection ports 12 adjoining in the y direction are recurrently and and nd as described above. In FIG. 4, m is 9 and n is 3. The ejection ports 12 are arranged substantially linearly in an oblique direction on the xy plane, and constitute ejection port arrays 24 illustrated by dash-dot-dot lines. The number of ejection ports 12 constituting each ejection port array 24 is 6((m+n)/2)). The positions in the y direction of the ejection ports 12 adjoining in the ejection port arrays are displaced by 2d.

In the configuration described above, regarding the y direction, at a position between two ejection ports 12 adjoining in the ejection port array, an ejection port 12 which constitutes the ejection port array 24 adjoining that ejection port array 24 is located. The ejection ports 12 may therefore be arranged at the pitch of d in the y direction. Since the number of ejection ports 12 constituting each ejection port array 24 is the same, the ejection mechanism units are arranged at regular intervals, with no gap, and with high density.

Although the ejection ports 12 are arranged at the pitch of 2.5d in the x direction in FIG. 4, the ejection ports 12 may be arranged at any pitches in the x direction. For example, in a case where a large number of ejection mechanism units, divided into two groups, are driven by time-divisional driving, an error of droplet landing positions related to the time-divisional driving may be reduced by multiplying the pitch of the ejection ports 12 in the x direction by (integer+0.5)d and alternately driving each line in the x direction as illustrated in FIG. 4.

If the pitch of the ejection ports 12 in the x direction is changed significantly, however, the pitch of the pressure chambers 11 becomes uneven and the ejection mechanism units 15 are not able to be arranged with high density. Desirably, therefore, the pitch of the ejection port 12 in the x direction is substantially constant. The ejection port array 24 is not perfectly linear when the pitch of the ejection ports 12 in the x direction is not substantially constant, but is substantially linear when the pitch of the ejection ports 12 in the x direction is substantially constant. As described with reference to FIG. 2C, when the ejection port array 24 is formed to be substantially linear in an oblique direction on the xy plane, the discrete wiring 18 may easily be pulled out in the x direction even if a large number of ejection mechanism units 15 are arranged with high density.

The positions of the ejection ports in the y direction adjoining in the ejection port array are displaced by 2d as described above. Regarding the y direction, at a position between two ejection ports 12 adjoining in the ejection port array, an ejection port 12 which constitutes the ejection port array 24 adjoining that ejection port array 24 is located. Therefore, the ejection ports 12 may be arranged at the pitch of d in the y direction as a whole.

To satisfy the above relationship of arrangement of the ejection ports 12, in the present embodiment, m and n used as indices defining the distance between the ejection ports 12 in the y direction constituting two adjoining ejection port arrays 24 are different odd numbers. Note that if m or n is 1, the thickness of the partition walls of the pressure chambers of the adjoining ejection mechanism units 15 is insufficient, so m and n need to be 3 or greater. Since m and n are odd numbers, (m+n)/2 is an integer. Thus the number of ejection ports 12 constituting each ejection port array 24 is set to (m+n)/2, the number of ejection ports 12 constituting each ejection port array 24 may be made equal, and the ejection ports 12 may be disposed at necessary positions. The ejection mechanism units 15 may therefore be arranged with high density, without creating useless space.

Next, a configuration of the end portion in the y direction of the head chip 7 is described.

Figure 5:
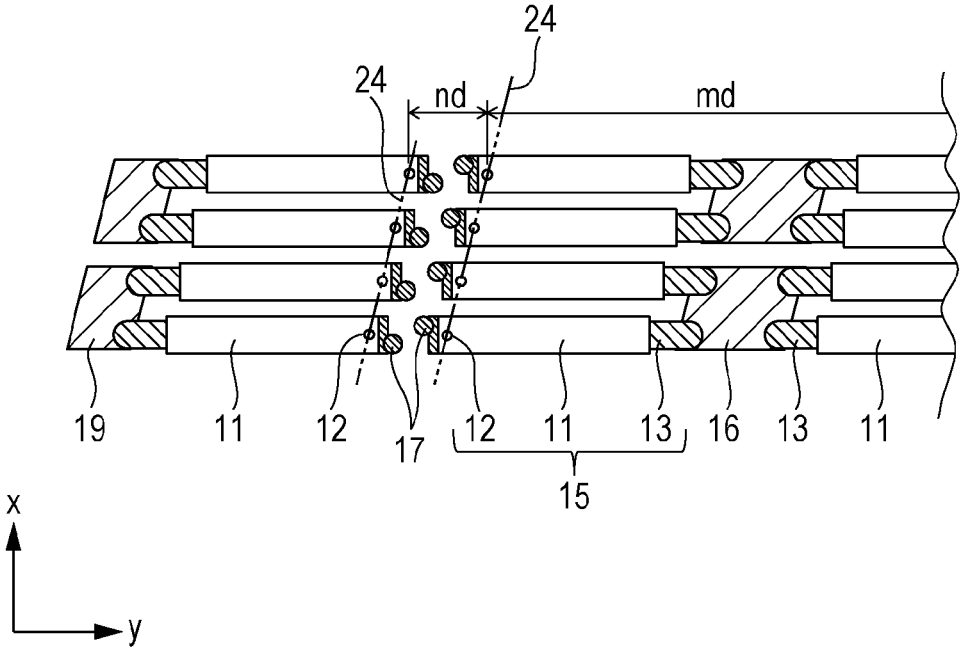
FIG. 5 illustrates an exemplary arrangement of the ejection ports in the liquid ejection head illustrated in FIGS. 2A to 2C.

FIG. 5 illustrates a configuration near the left end of the head chip 7. As described above, since the ejection ports 12 that constitute adjoining ejection port arrays 24 are disposed alternately in the y direction in the present embodiment, desired recording density is achieved. Therefore, desired recording density is not attained at portions where the ejection ports 12 which constitute the adjoining ejection port arrays 24 are not alternately located in the y direction when the positions of the ejection ports 12 constituting the ejection port array 24 are projected on the y axis. Thus the ejection mechanism units 15 at these portions are invalid.

To eliminate invalid ejection mechanism units 15 and to reduce the size of the liquid ejection head 4, the distance between the ejection port 12 constituting the endmost ejection port array 24 in the y direction and the ejection port 12 constituting the second endmost ejection port array 24 is desirably nd. By eliminating invalid ejection mechanism units 15 near the both end portions in the y direction of the two-dimensionally arranged ejection mechanism units 15, the number of ejection mechanism units constituting the ejection port array 24 may be reduced to smaller than (m+n)/2.

When the distance between the ejection port 12 constituting the endmost ejection port array 24 in the y direction and the ejection port 12 constituting the second endmost ejection port array 24 is nd, a supply portion 19 (i.e., a second supply portion) needs to be provided between the ejection port 12 of the endmost ejection port array 24 and the end portion in the y direction of the head chip 7. When the width of the supply portion 19 in the y direction is set to be smaller than the width of the supply portion 16 in the y direction, the size of the head chip 7 may be reduced. Thus, in addition to the size of the entire liquid ejection head 4, the manufacturing cost thereof may be reduced. The supply portion 16 needs to supply a liquid to the pressure chambers 11 of the ejection mechanism units 15 connected on both sides thereof in the y direction, but the supply portion 19 only needs to supply a liquid to the pressure chamber 11 of the ejection mechanism unit 15 connected to one side thereof in the y direction. For this reason, performance of the ejection mechanism unit 15 is not affected even if the width in the y direction of the supply portion 19 is set to be smaller than the width in the y direction of the supply portion 16.

Although the form in which the supply portion penetrating the substrate 20 supplies the liquid to the pressure chambers 11 has been described, this is not restrictive. For example, in a cross section of the liquid ejection head 4, a flow path substantially parallel to the ejection port arrays 24 may be provided at a position further toward the ejection ports 12 than the substrate 20.

In the present embodiment, as described above, the liquid ejection head 4 includes a plurality of two-dimensionally arranged ejection ports 12, and a plurality of pressure chambers 11 arranged two-dimensionally corresponding to each of the plurality of ejection ports. A plurality of ejection ports 12 are arranged in a manner such that the distances between the ejection ports 12 adjoining in the y direction are alternately and recurrently and and nd and are arranged to form a plurality of ejection port arrays 24 extending substantially linearly in an oblique direction on the xy plane. Moreover, the ejection port array is constituted by (m+n)/2 ejection ports, and the positions in the y direction of the ejection ports 12 adjoining in the ejection port arrays are displaced by 2d.

With the configuration described above, since the ejection ports 12 that constitute the adjoining ejection port arrays 24 are disposed alternately in the y direction, the ejection ports 12 may be disposed at the same pitch as that of the pixels in the y direction. In each ejection port array 24, the same number of ejection ports may be arranged in the y direction at the pitch of d, i.e., at the same pitch as that of the pixels in the y direction to be stored. Since each ejection port array 24 is constituted by (m+n)/2 ejection ports 12, the entire range in the y direction to be recorded by the pixels may fall within each ejection port array, and the ejection mechanism units 15 may be arranged with high density, without creating useless space. Moreover, since m and n is odd numbers of 3 or greater, the thickness of the partition walls of the pressure chambers 11 corresponding to the ejection ports 12 adjoining in the y direction is sufficiently large, whereby performance of the ejection mechanism units 15 is not impaired. Therefore, the ejection mechanism units 15 may be arranged with high density, while satisfying design requirements.

Second Embodiment

Figure 6:
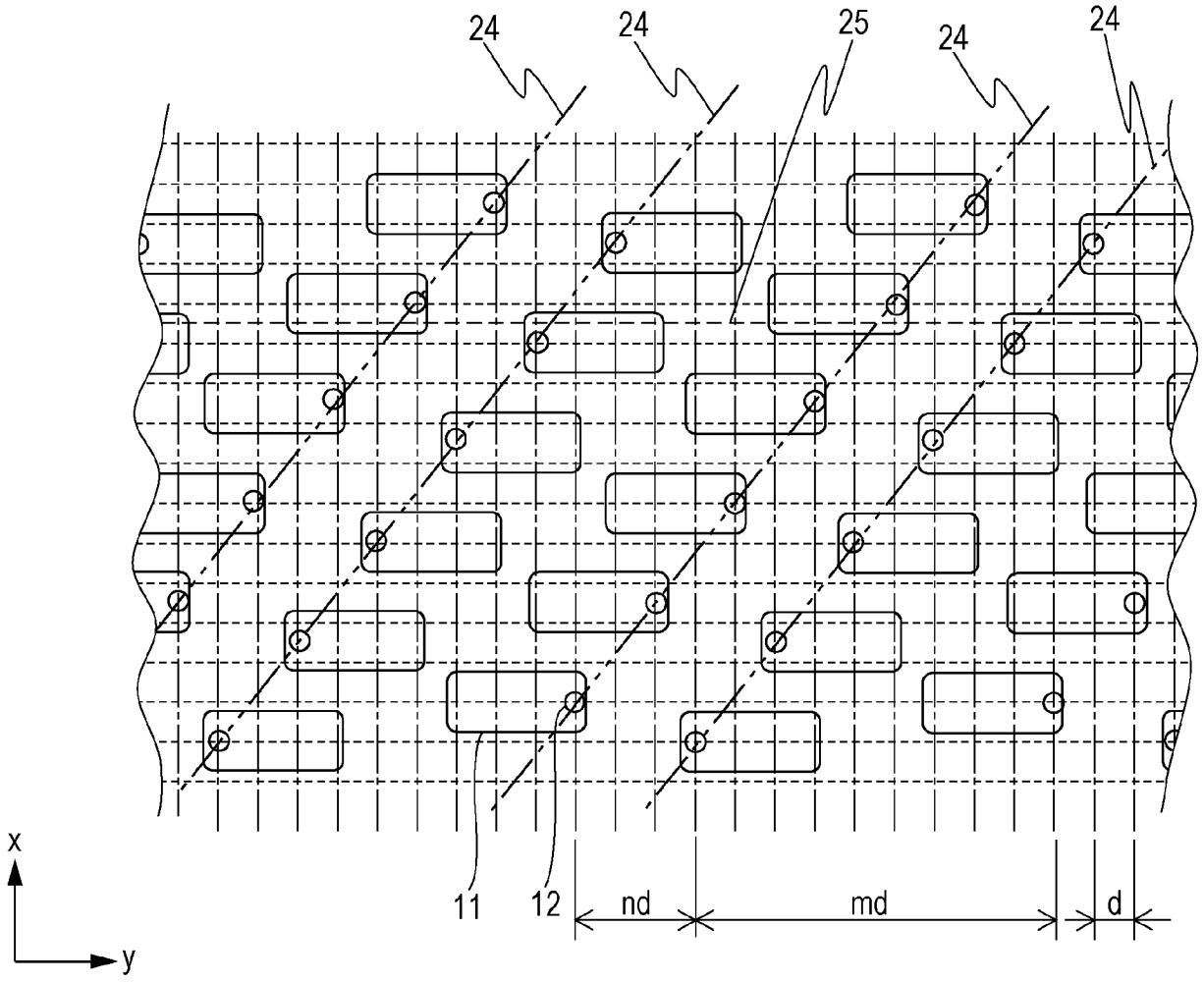
FIG. 6 illustrates an exemplary arrangement of ejection ports according to a second embodiment of the present invention.

FIG. 6 illustrates an arrangement of ejection ports 12 according to a second embodiment of the present invention.

In the present embodiment, the ejection ports 12 are not arranged perfectly linearly in the y direction, but is arranged in a zigzag manner on both sides of a dotted line 25 that is parallel to the y axis. Since the distances between the ejection ports 12 in the y direction are alternately and recurrently and and nd even if the ejection ports 12 are arranged in a zigzag manner in the y direction, the ejection mechanism units 15 may be arranged with high density, while satisfying design requirements as in the first embodiment.

Since the ejection ports 12 are arranged in the y direction in a zigzag manner, some excessive space is created at the end portions in the x direction of the head chip 7. However, the space is small and may be used for the connection of electrical wiring and the like.

Although different from the configuration illustrated in FIG. 6, the ejection ports 12 may be arranged in a manner to be displaced by a certain amount, not an integer multiple of d, in the x direction. This may reduce a droplet landing error related to time-divisional driving when the ejection mechanism units 15, divided into a plurality of groups, are driven by time-divisional driving.

Third Embodiment

Figure 7:
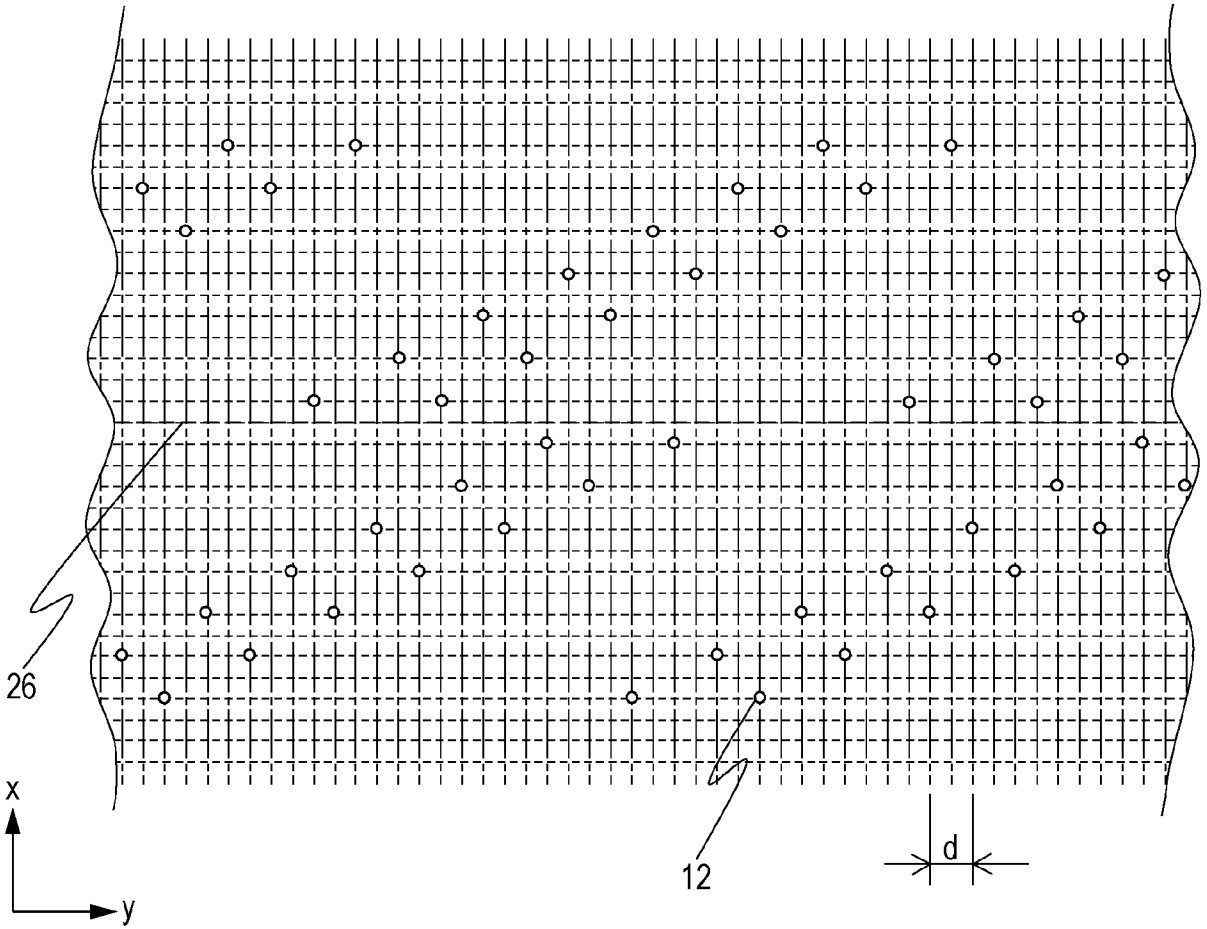
FIG. 7 illustrates an exemplary arrangement of ejection ports according to a third embodiment of the present invention.

FIG. 7 illustrates an arrangement of ejection ports 12 according to a third embodiment of the present invention. In FIG. 7, the grid illustrated by the vertical lines (dash-dot lines) and the horizontal lines (dotted lines) represents the magnitude of the pixels to be recorded. Only the ejection ports 12 among the components of the ejection mechanism units 15 are illustrated in FIG. 7.

In the present embodiment, ejection port groups are located at upper and lower areas on both sides of the central dotted line 26. In the ejection port group located below the dotted line 26, the ejection ports 12 are arranged substantially linearly in an oblique direction on the xy plane, and each line is constituted by seven ejection ports 12. The distance between the ejection ports 12 in the y direction is 22 pixels and 6 pixels. Here, if d is twice the pitch of the pixels, the distance between the ejection ports 12 in the y direction is alternately and recurrently and (m=11) and nd (n=3). The number of ejection ports 12 constituting each line is 7 (=(11+3)/2). The distance between the ejection ports 12 adjoining on the line in the y direction is displaced by 2 pixels, i.e., by 2d.

With this configuration, the ejection port group located below the dotted line 26 may perform recording at a 2-pixel pitch. The ejection port group located above the dotted line 26 has the same arrangement as that of the ejection port group located below the dotted line 26 and, therefore, may perform recording at the 2-pixel pitch. Thus, recording at 1-pixel pitch may be performed by combining the lower side ejection port group and the upper side ejection port group.

A large number of wires need to be provided to drive a piezoelectric element 23 (not illustrated) provided in the pressure chamber 11 (not illustrated) corresponding to each ejection port 12. In a case where the large number of wires are pulled out in the x direction, it is only necessary to pull out wires for driving the piezoelectric elements 23 provided in the pressure chambers 11 corresponding to the ejection ports 12 located above the dotted line 26 upward in the x direction. Moreover, it is only necessary to pull out wires for driving the piezoelectric elements 23 provided in the pressure chambers 11 corresponding to the ejection ports 12 located below the dotted line 26 downward in the x direction. This eliminates the need of bending in a complicated manner the wiring of the piezoelectric element 23 of each ejection mechanism unit 15 to evade bumps 17 corresponding to other ejection mechanism units 15 and supply portions 16. Thus, wiring may be provided without disturbance even if the ejection mechanism units 15 are arranged with high density.

In the present embodiment, the distance between the ejection ports 12 adjoining in the x direction that record the pixels adjoining in the y direction are shorter than the entire arrangement of the ejection ports 12 in the y direction. If the recording paper 1 meanders during conveyance as illustrated in FIG. 1, the distance between adjoining pixels is unfavorably changed. Even in this case, since the distance between the ejection ports 12 in the x direction that record the pixels adjoining in the y direction is short, the influence of the above problem may be reduced.

Fourth Embodiment

Figure 8A:
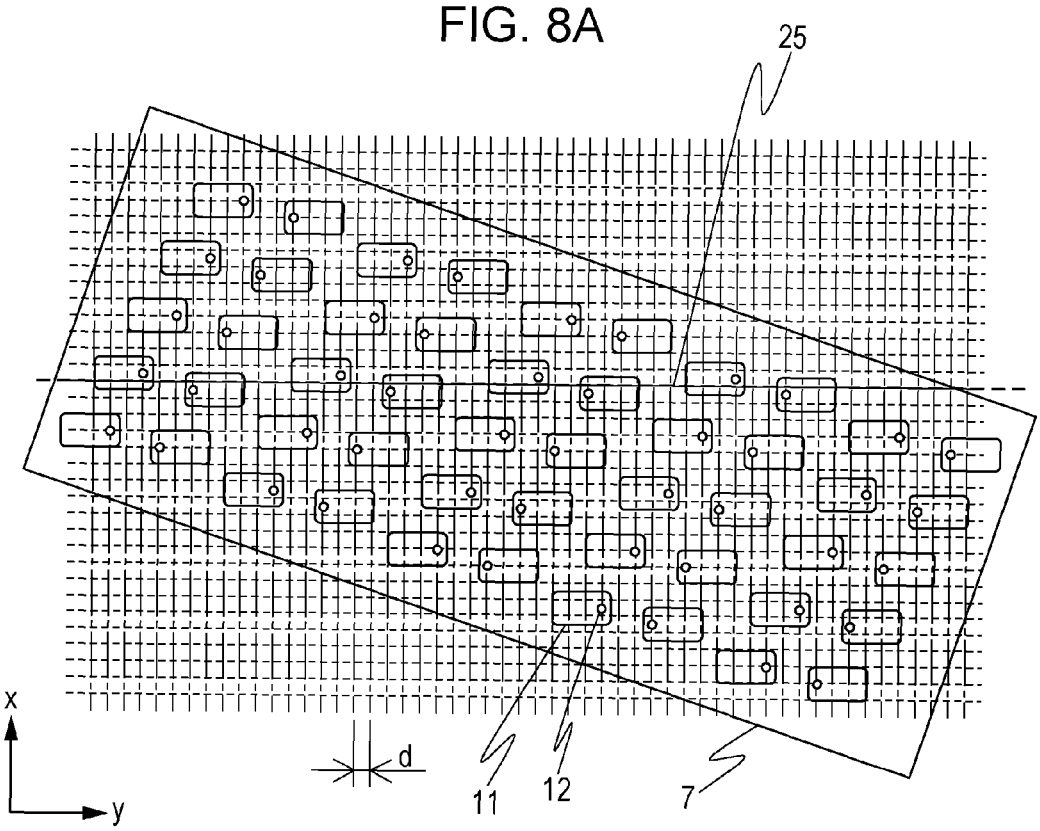
FIGS. 8A and 8B illustrate an exemplary arrangement of ejection ports according to a fourth embodiment of the present invention.

FIG. 8A illustrates an arrangement of ejection ports 12 according to a fourth embodiment of the present invention.

Figure 8B:
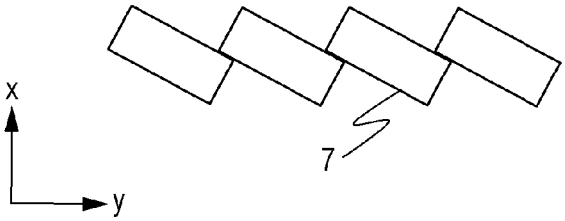

In the present embodiment, the ejection ports 12 are arranged linearly in an oblique direction, and the entire ejection port group is arranged in a rectangular region inclined on the xy plane. With this arrangement of the ejection ports 12, the head chip 7 may be a rectangular shape inclined with respect to the x direction and the y direction. Thus the area of the substrate 20 and therefore the manufacturing cost may be reduced. If a liquid ejection head with a recording area of wide width is constituted by a plurality of head chips 7 in which a large number of ejection mechanism units are arranged, the size of the liquid ejection head in the x direction may be made relatively small by regularly arranging the inclined head chips 7 (see FIG. 8B).

According to the present invention, the ejection mechanism units may be arranged with high density, while satisfying design requirements.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-175521, filed Aug. 29, 2014 which is hereby incorporated by reference herein in its entirety.

What is claimed is:

1. A liquid ejection apparatus comprising:

a liquid ejection head including, a plurality of two-dimensionally arranged pressure chambers, and a plurality of ejection ports each corresponding to the plurality of pressure chambers, wherein the liquid ejecting apparatus is configured to record on a recording material with a liquid ejected from the ejection ports while the liquid ejection head and the recording material are moving relatively, wherein, on a surface on which the ejection ports are arranged, if a direction of relative movement of the recording material is defined as an x direction, a direction perpendicular to the relative movement is defined as a y direction, a pitch of pixels to be recorded in the y direction is denoted by d, and m and n are different odd numbers of 3 or greater, the plurality of ejection ports are arranged in a manner such that md and nd are repeated alternately as the distance between the ejection ports adjoining in the y direction, and such that a plurality of ejection port arrays extending substantially linearly in an oblique direction with respect to the x direction and the y direction on an xy plane are formed, the ejection port arrays are constituted by (m+n)/2 ejection ports, and positions of the ejection ports adjoining in the ejection port array are displaced by 2d.

2. The liquid ejection apparatus according to claim 1, further comprising a first supply portion provided at an area where, if m>n, a distance between the ejection ports adjoining in the y direction is md, and configured to supply a liquid to the pressure chambers, wherein pressure chambers corresponding to ejection ports adjoining in the y direction on both sides of the first supply portion are connected to the first supply portion.

3. The liquid ejection apparatus according to claim 1, wherein a plurality of pressure generation units provided corresponding to each of the plurality of pressure chambers and configured to generate pressure for ejecting a liquid in the pressure chamber from the ejection port, and wiring for independently driving each of the plurality of pressure generation units is pulled out toward the x direction.

4. The liquid ejection apparatus according to claim 1, wherein, if m>n, a distance in the y direction between an ejection port constituting an endmost ejection port array in the y direction and an ejection port constituting an ejection port array adjoining the endmost ejection port array is nd.

5. The liquid ejection apparatus according to claim 1, further comprising a second supply portion provided between the ejection port constituting the endmost ejection port array in the y direction and an end portion in the y direction of a head chip in which the ejection port and the pressure chamber are formed, and configured to supply a liquid to a pressure chamber corresponding to the ejection port constituting the endmost ejection port array in the y direction, wherein the second supply portion is smaller in the width in the y direction than the first supply portion.

6. The liquid ejection apparatus according to claim 1, wherein the plurality of ejection ports are arranged in a rectangular region inclined with respect to the x direction and the y direction.

7. A liquid ejection head comprising:

a liquid ejection apparatus having a liquid ejection head including, a plurality of two-dimensionally arranged pressure chambers, and a plurality of ejection ports each corresponding to the plurality of pressure chambers, wherein, if a first direction on a surface on which the ejection ports are arranged is defined as an x direction, a direction perpendicular to the first direction is defined as a y direction, a pitch of pixels to be recorded in the y direction is denoted by d, and m and n are different odd numbers of 3 or greater, the plurality of ejection ports are arranged in a manner such that and and nd are repeated alternately as the distance between the ejection ports adjoining in the y direction, and such that a plurality of ejection port arrays extending substantially linearly in an oblique direction with respect to the x direction and the y direction on an xy plane are formed, the ejection port arrays are constituted by (m+n)/2 ejection ports, and positions of the ejection ports adjoining in the ejection port arrays are displaced by 2d.

8. The liquid ejection head according to claim 7, further comprising a first supply portion provided at an area where, if m>n, a distance between the ejection ports adjoining in the y direction is md, and configured to supply a liquid to the pressure chambers, wherein pressure chambers corresponding to ejection ports adjoining in the y direction on both sides of the first supply portion are connected to the first supply portion.

9. The liquid ejection head according to claim 7, wherein a plurality of pressure generation units provided corresponding to each of the plurality of pressure chambers and configured to generate pressure for ejecting a liquid in the pressure chamber from the ejection port, and wiring for independently driving each of the plurality of pressure generation units is pulled out toward the x direction.

10. The liquid ejection head according to claim 7, wherein if m>n, a distance in the y direction between an ejection port constituting an endmost ejection port array in the y direction and an ejection port constituting an ejection port array adjoining the endmost ejection port array is nd.

11. The liquid ejection head according to claim 7, further comprising a second supply portion provided between the ejection port constituting the endmost ejection port array in the y direction and an end portion in the y direction of a head chip in which the ejection port and the pressure chamber are formed, and configured to supply a liquid to a pressure chamber corresponding to the ejection port constituting the endmost ejection port array in the y direction, wherein the second supply portion is smaller in the width in the y direction than the first supply portion.

12. The liquid ejection head according to claim 7, wherein the plurality of ejection ports are arranged in a rectangular region inclined with respect to the x direction and the y direction.

* * * * *